US009789379B1

(12) United States Patent
Bynum

(10) Patent No.: US 9,789,379 B1
(45) Date of Patent: Oct. 17, 2017

(54) BALL DELIVERY SYSTEM

(71) Applicant: About 52 Feet, LLC, Santa Rosa, CA (US)

(72) Inventor: Maximilian T. Bynum, Santa Rosa, CA (US)

(73) Assignee: About 52 Feet, LLC, Santa Rosa, CA (US)

( * ) Notice: Subject to any disclaimer, the term of this patent is extended or adjusted under 35 U.S.C. 154(b) by 149 days.

(21) Appl. No.: 13/828,685

(22) Filed: Mar. 14, 2013

Related U.S. Application Data

(60) Provisional application No. 61/707,774, filed on Sep. 28, 2012.

(51) Int. Cl.
*A63B 69/40* (2006.01)
*F41B 4/00* (2006.01)
*A63B 69/00* (2006.01)

(52) U.S. Cl.
CPC ..... *A63B 69/406* (2013.01); *A63B 69/40* (2013.01); *F41B 4/00* (2013.01); *A63B 2069/0008* (2013.01); *A63B 2069/402* (2013.01)

(58) Field of Classification Search
CPC ..... A63B 69/406; A63B 2069/402; A63B 2069/0008; A63B 69/40; F41B 4/00
USPC ..... 124/78, 81; 473/451
See application file for complete search history.

(56) References Cited

U.S. PATENT DOCUMENTS 3,538,900 A * 11/1970 Samuels ..... A63B 69/406 124/34
3,777,732 A * 12/1973 Holloway ..... A63B 69/406 124/50
3,811,421 A * 5/1974 Betten ..... A63B 69/406 124/78
4,026,261 A * 5/1977 Paulson ..... A63B 69/406 124/78
4,086,903 A * 5/1978 Scott ..... A63B 69/406 124/78
4,352,348 A * 10/1982 Griffith ..... A63B 69/406 124/34
4,442,823 A * 4/1984 Floyd ..... A63B 69/406 124/41.1
4,596,230 A * 6/1986 Griffith ..... A63B 69/406 124/50
4,712,534 A * 12/1987 Nozato ..... A63B 69/406 124/3
4,723,532 A * 2/1988 Osojnak ..... A63B 69/406 124/48
4,823,763 A * 4/1989 Ponza ..... A63B 69/406 124/1
5,125,653 A * 6/1992 Kovacs ..... A63B 69/406 124/78

(Continued)

*Primary Examiner* — Alexander Niconovich
(74) *Attorney, Agent, or Firm* — North Weber & Baugh LLP

(57) ABSTRACT

This invention relates generally to a ball delivery system and method, and more particularly to a ball delivery system where the axis of rotation of the ball delivered from the system can range from perpendicular to the direction of motion of the ball to parallel to the direction of motion. This invention also permits a user to enter information related to the speed and axis of rotation of the ball. This invention also permits information related to the speed and axis of rotation of the ball to be determined from a video of a ball.

19 Claims, 13 Drawing Sheets

(56) References Cited

U.S. PATENT DOCUMENTS 5,464,208 A * 11/1995 Pierce ..... A63B 69/406 124/78
5,865,161 A * 2/1999 Bruce ..... A63B 69/406 124/78
5,897,445 A * 4/1999 Sanders ..... A63B 24/0003 473/421
6,024,078 A * 2/2000 Hollis et al. ..... F41B 4/00 124/78
6,082,350 A * 7/2000 Crews et al. ..... A63B 47/00 124/78
6,152,126 A * 11/2000 Smith et al. ..... A63B 69/0002 124/78
6,182,649 B1 * 2/2001 Battersby et al. ... A63B 69/406 124/78
6,237,583 B1 * 5/2001 Ripley et al. ..... A63B 47/002 124/78
6,440,013 B1 * 8/2002 Brown ..... A63B 69/406 124/6
6,488,020 B1 * 12/2002 Rosas-Magallan .. A63B 69/406 124/78
6,880,542 B1 * 4/2005 Johndreau et al. .. A63B 69/406 124/78
6,983,741 B2 * 1/2006 Donald ..... A63B 69/406 124/6
7,011,084 B2 * 3/2006 Richard ..... A63B 69/406 124/78
7,082,938 B2 * 8/2006 Wilmot ..... A63B 69/406 124/78
7,100,594 B2 * 9/2006 Boehner ..... A63B 69/406 124/78
7,691,012 B2 * 4/2010 Cucjen ..... A63B 69/406 124/78
7,882,831 B2 * 2/2011 Alger ..... A63B 69/406 124/6
8,893,698 B2 * 11/2014 Boehner ..... A63B 69/406 124/78
9,010,309 B2 * 4/2015 Lewis ..... A63B 69/40 124/4
9,022,016 B1 * 5/2015 Hafer ..... F41B 4/00 124/6
9,050,520 B2 * 6/2015 Lu ..... A63B 69/406
2005/0166905 A1 * 8/2005 Boehner ..... A63B 69/406 124/78
2006/0236993 A1 * 10/2006 Cucjen ..... A63B 69/406 124/78
2009/0095273 A1 * 4/2009 Paulson ..... A63B 69/0002 124/78
2009/0260612 A1 * 10/2009 Grant ..... A63B 69/406 124/78
2013/0087131 A1 * 4/2013 Paulson ..... H02P 8/34 124/78
2013/0109510 A1 * 5/2013 Boehner ..... A63B 69/406 473/436
2013/0319387 A1 * 12/2013 Paulson ..... A63B 69/406 124/10
2014/0261363 A1 * 9/2014 Lu ..... A63B 69/406 124/78

* cited by examiner

BALL DELIVERY SYSTEM

CROSS REFERENCE TO RELATED APPLICATIONS

This application claims the benefit of U.S. Provisional Application No. 61/707,774, filed Sep. 28, 2012.

BACKGROUND

A. Technical Field

This invention relates generally to a ball delivery system and method, and more particularly to a ball delivery system where the axis of rotation of the ball delivered from the system can range from perpendicular to the direction of motion of the ball to parallel to the direction of motion.

B. Background of the Invention

A ball delivery system is a machine designed to release a ball in a particular direction towards a target. These machines can be useful for practicing sports that use balls, for example, tennis, baseball, ping pong, football or any other sport where a ball is used. The system essentially "throws" a ball to simulate the action of a ball being hit by a tennis racquet, a pitch by a baseball pitcher, or a football thrown by a quarterback. There are several reasons these machines are used. The machines can be used when a tennis partner or baseball pitcher are unavailable, for example. They can also be used to practice a particular action over and over again, for example to practice hitting a fastball many times.

There are two types of prior art ball delivery systems. One is a swinging arm delivery system and the other is a spinning wheel type delivery system. The swinging arm delivery system operates by swinging a mechanical arm with a ball at the end of it. The arm swings and releases the ball. Thus, the ball is "thrown" with a particular velocity and rotation in the direction of a target.

The spinning wheel delivery system operates by having two spinning wheels where the ball gets squeezed between them to be "thrown."

Both of these types of delivery systems have disadvantages. One major disadvantage of both is that there is a limitation in that the axis of rotation of the ball delivered by the system cannot be quantitatively controlled and often must be perpendicular to the direction of motion of the ball. This limitation does not exist in other situations in real life sports, for example, a human pitcher pitching a baseball or a ball being hit with a tennis racquet. Real pitches in baseball don't necessarily have an axis of rotation perpendicular to the direction of travel. Therefore, with the existing pitching machines, a batter cannot practice for scenarios with an axis of rotation that, the orientation of which, can be quantitatively controlled.

SUMMARY OF THE INVENTION

Embodiments of the present invention overcome the disadvantages of the prior art ball delivery systems by allowing a ball to be delivered with an axis of rotation that can range from perpendicular to the direction of motion of the ball to parallel to the direction of motion. Embodiments of the present invention use a microcontroller coupled to a driver to control a stepper motor. The stepper motor is rotatably coupled to a spinner carriage. The spinner carriage houses two spinners. The two spinners deliver the ball. The spinners can be controlled independently of each other. The control includes both the ability to independently control the rotational speed of the spinners and independently control the angle of the spinners relative to each other. This independent control of the rotational speed and angle of the spinners provides for control of the axis of rotation of the ball.

Embodiments of the present invention overcome the limitations of the prior art because it is advantageous to simulate real life situations. Embodiments of the present invention provide for quantitative control over the velocity and axis of rotation of the ball delivered by the system.

Embodiments of the present invention are achieved in a user friendly manner and can be controlled by a portable computer such as a laptop or by a tablet or smart phone. Alternatively, other devices may be used to control the spinners, for example other mobile devices, personal computers (PCs), game systems, cameras, front facing cameras, video recording devices, wearable computers, etc.

Other objects and attainments together with a fuller understanding of the invention will become apparent and appreciated by referring to the following description and claims taken in conjunction with the accompanying drawings.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

The following description is set forth for purpose of explanation in order to provide an understanding of the invention. However, it is apparent that one skilled in the art will recognize that embodiments of the present invention, some of which are described below, may be incorporated into a number of different computing systems and devices. The embodiments of the present invention may be present in hardware, software or firmware. Structures shown below in the diagram are illustrative of exemplary embodiments of the invention and are meant to avoid obscuring the invention. Furthermore, connections between components within the figures are not intended to be limited to direct connections. Rather, data between these components may be modified, re-formatted or otherwise changed by intermediary components.

Reference in the specification to "one embodiment", "in one embodiment" or "an embodiment" etc. means that a particular feature, structure, characteristic, or function described in connection with the embodiment is included in at least one embodiment of the invention. The appearances of the phrase "in one embodiment" in various places in the specification are not necessarily all referring to the same embodiment.

Figure 1A:
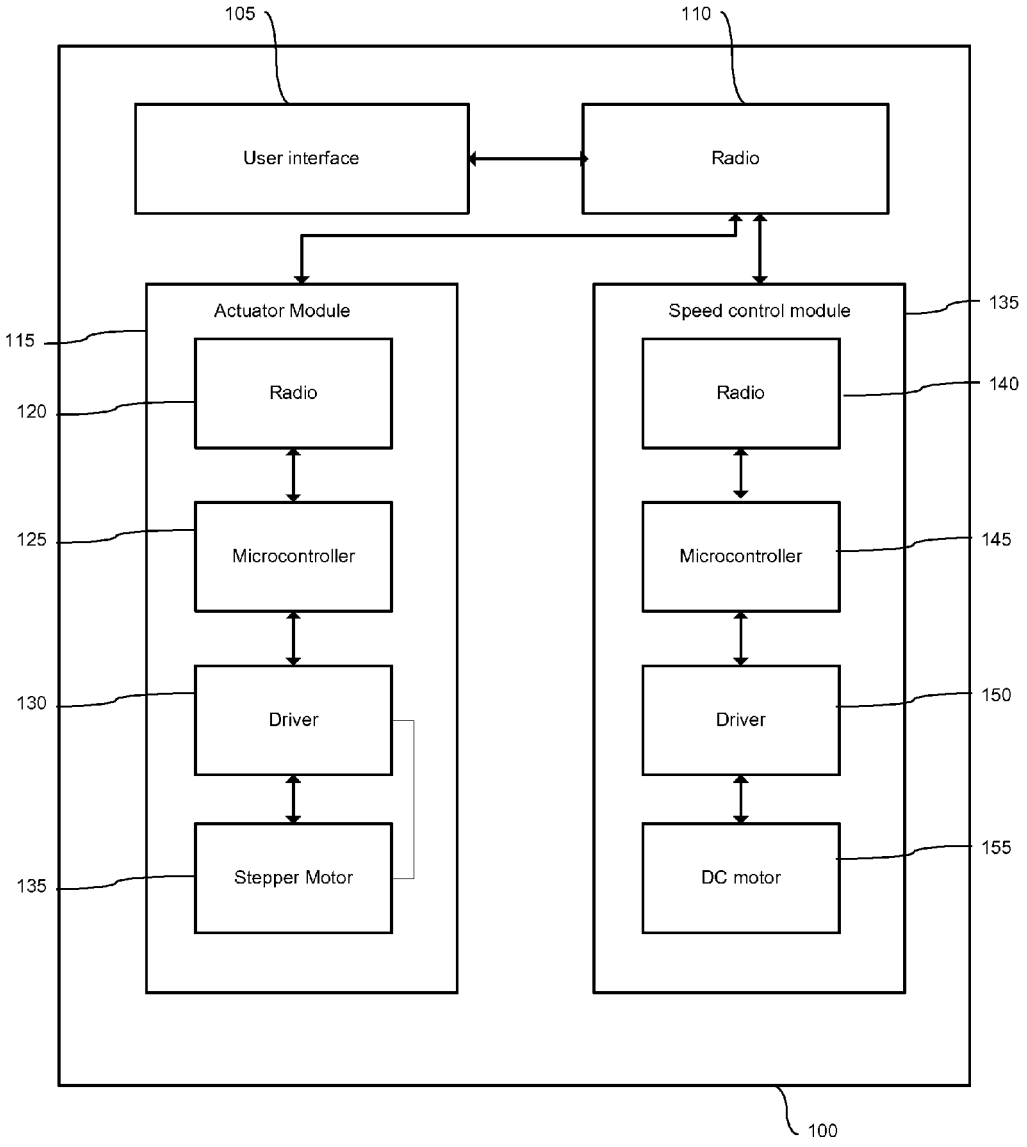
FIG. 1*a* shows a functional block diagram showing control modules, in accordance with various aspects of the present invention.
Figure 3:
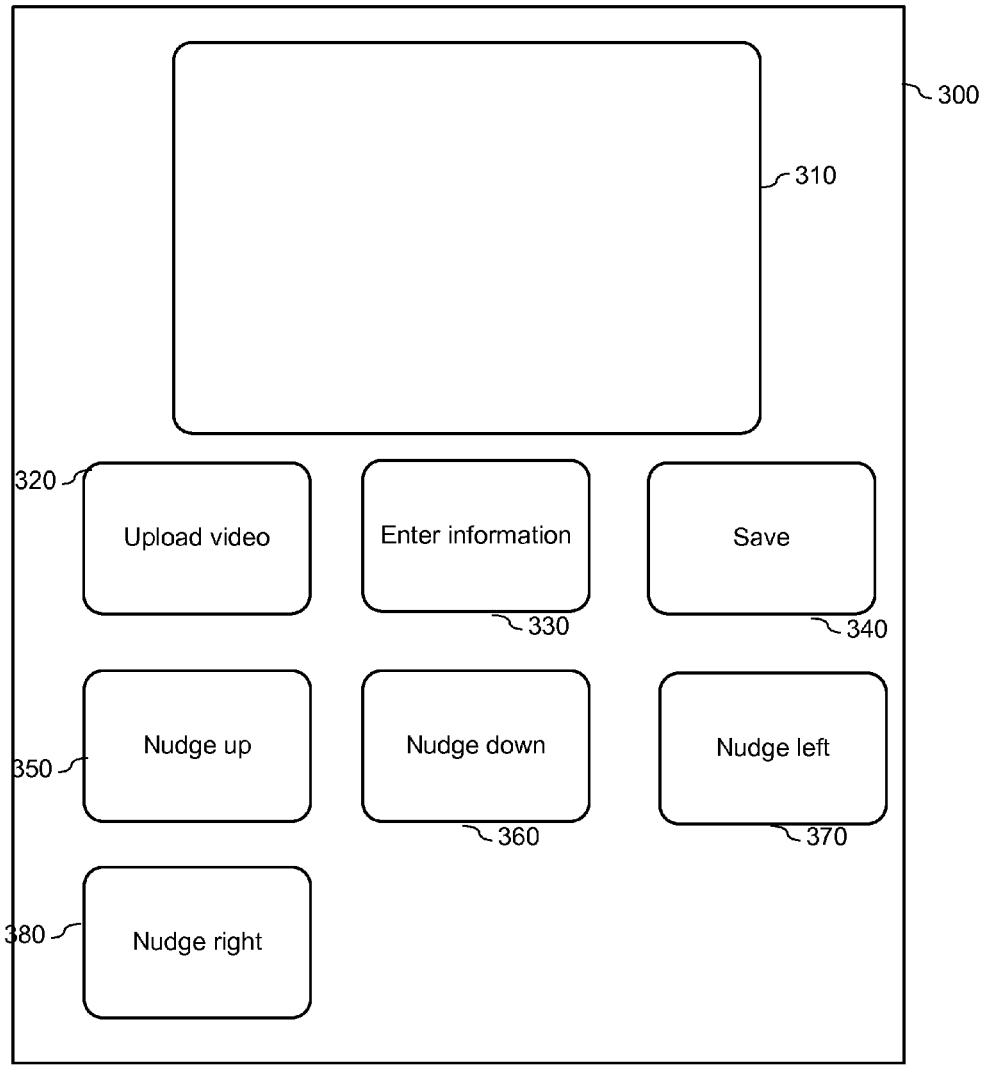
FIG. 3 shows a user interface used in conjunction with a ball delivery system, in accordance with various aspects of the present invention.

FIG. 1*a* shows a functional block diagram, in accordance with various aspects of the present invention. FIG. 1*a* shows a ball delivery system 100, including user interface 105. The user interface 105 can be any user interface implemented electronically or mechanically. One example of a user interface is depicted in FIG. 3. In one embodiment, the user interface 105 permits a user to enter information about ball delivery manually, by video, or by selecting from saved deliveries.

Embodiments of the present invention use a radio 110 to communicate between the user interface 105 and an actuator module 115 and a speed control module 135. The actuator module comprises radio 120, microcontroller 125, driver 130 and stepper motor 135. The actuator module operates to control the angle of orientation of a spinner in the ball delivery system 100. The speed control module comprises radio 140, microcontroller 145, driver 150 and direct current (DC) motor 155. The speed control module operates to control the speed of rotation of a spinner in the ball delivery system 100.

In one embodiment, radio 120 interfaces with radio 110 to communicate between the user interface 105 and microcontroller 125. Microcontroller 125 and driver 130 operate to control the stepper motor 135. In one embodiment driver 130 is implemented using ST Micro L6470. Stepper motor 135 is used to control the angle of orientation of a spinner in the ball delivery system 100. In one embodiment, radio 120, microcontroller 125, driver 130, and stepper motor 135 also permits independent control over the angle of orientation of the spinners. Thus, the angle of one spinner can be controlled independently of the angle of the other spinner.

In one embodiment, radio 140 interfaces with radio 110 to communicate between the user interface 105 and microcontroller 145. Microcontroller 145 and driver 150 operate to control the DC motor 155. DC motor 155 is used to control the rotational speed or revolutions per minute (RPM) of a spinner in the ball delivery system 100. In one embodiment, radio 140 microcontroller 145, driver 150, and DC motor 155 also permits independent control over the RPM of the spinners. Thus, the RPM of one spinner can be controlled independently of the RPM of the other spinner.

Figure 1B:
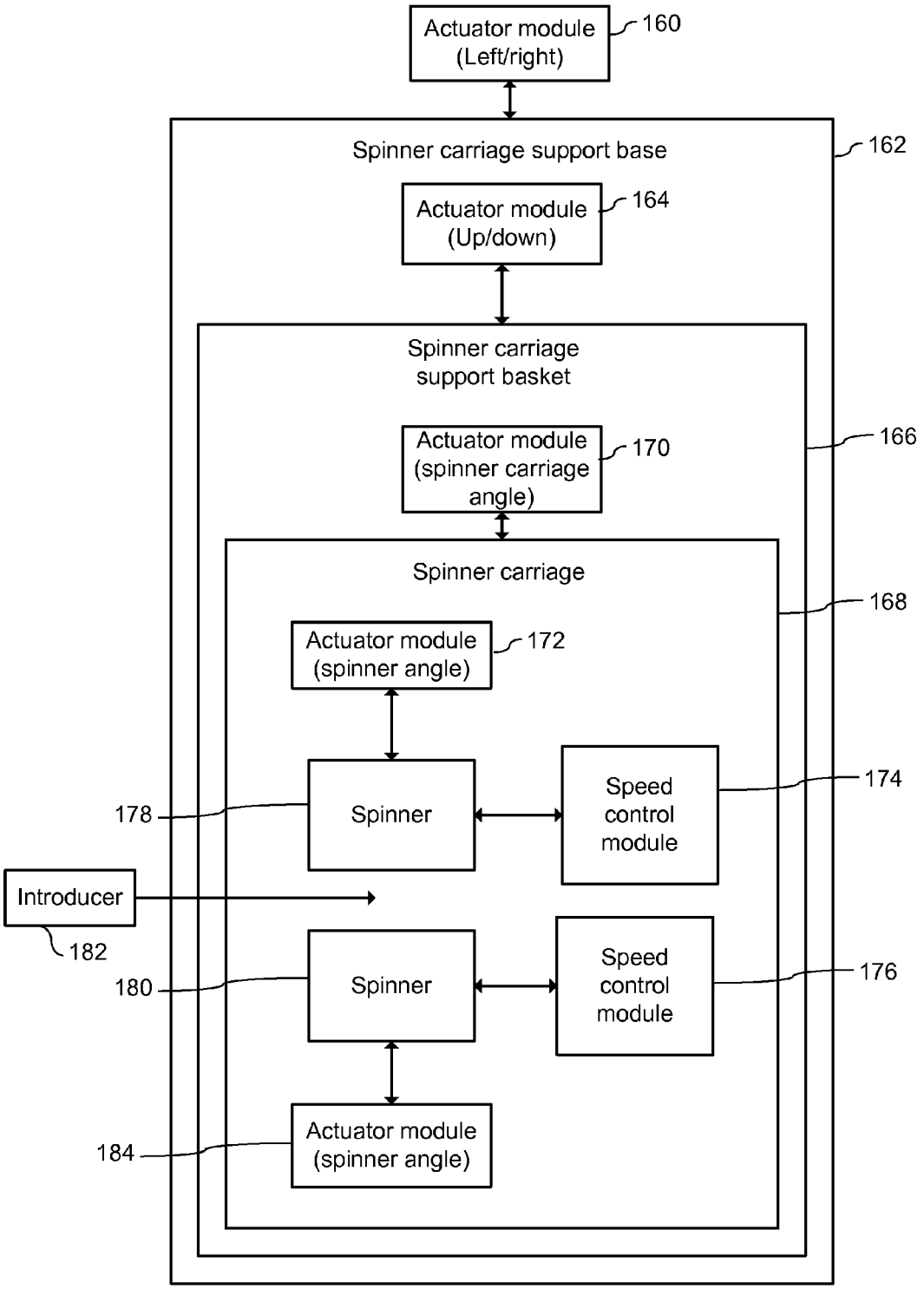
FIG. 1*b* shows a functional block diagram, in accordance with the various aspects of the present invention.

FIG. 1*b* shows a functional block diagram, in accordance with various aspects of the present invention. Embodiments of the present invention use spinners 178 and 180 to deliver a ball, referred to as delivery. Each delivery is described by several parameters, including the velocity of the ball, which includes the speed and direction of the ball, and the rotation of the ball, which includes the orientation of the axis of rotation and the revolutions per minute (RPMs) of the ball or the rotational velocity of the ball.

In one embodiment, the user interface 105 (shown in FIG. 1*a*) is a mechanical lever (not shown) that can be used to adjust the orientation of the axis of rotation. In another embodiment, the user interface 105 (shown in FIG. 1*a*) is a software interface further described in FIG. 3.

In the embodiment shown in FIG. 1*b*, actuator module 115 (shown in FIG. 1*a*) can be implemented as actuator module (left/right) 160, actuator module (up/down) 164, actuator module (spinner carriage angle) 170, actuator module (spinner angle) 172, and actuator module (spinner angle) 184. Actuator modules 172 and 184 control the angle of orientation of two spinners 178 and 180, independently. Speed control modules 174 and 176 (also shown in FIG. 1*a*) operate to control the rotational speed of spinners 178 and 180 independently. Together actuator modules 172 and 184, speed control modules 174 and 176, and spinners 178 and 180 comprise spinner carriage 168. Spinner carriage 168 is itself controlled by actuator module 170. Actuator module 170 can alter the angle of the spinner carriage 168. Actuator module 170 and spinner carriage 168 are supported by the spinner carriage support basket 166. The spinner carriage support basket 166 is controlled up and down by actuator module 164. Actuator module 164 and spinner carriage support basket 166 are supported by spinner carriage support base 162. Spinner carriage support base 162 is controlled left and right by actuator module 160.

Introducer 182 can be used to introduce the ball into the ball delivery system 100. Introducer 182 can be used to position the ball in a particular orientation, for example with the seams with a particular orientation for a baseball. Continuing with the baseball example, the user will orient the ball according to seam alignment at the end of the introducer 182 and the introducer will be inserted into a tube which is part of the spinner carriage 168. The introducer 182 and tube interface will be a keyed joint where one will have a key and the other a corresponding keyway in order to maintain the intended orientation with respect to the spinner as the spinner carriage is rotated. Introducer 182 can also be used to perform sequential ball deliveries from ball delivery system 100.

The entire ball delivery system can be physically placed by a user. The ball delivery system can be placed such that the ball will be delivered in the direction of a target. The location and angle of the system can be adjusted so that the ball goes in the desired direction and at an angle of elevation such that the ball reaches its target.

A user can essentially aim the ball delivery system. During the aiming process the spinner carriage can be rotated around the spinner carriage support assembly basket and the aiming process effectively alters the orientation of the ball's axis of rotation away from what was originally determined. Therefore, the ball delivery system can perform a coordinate system transformation each time either one or both of the above rotations are performed due to aiming in order to maintain the true orientation of the axis of rotation with respect to level ground and the target.

The user aims the ball delivery system using actuator modules 160 and 164. In response to the aiming, the ball delivery system performs a coordinate transformation that results in using actuator modules 170, 172 and 184 and speed control modules 174 and 176 to appropriately adjust the spinner speeds and angles of orientation. In one embodiment, once the user determines by trial and error the correct horizontal and vertical angles of declination, the delivery has been defined and the user can store and name that particular delivery.

Figure 2:
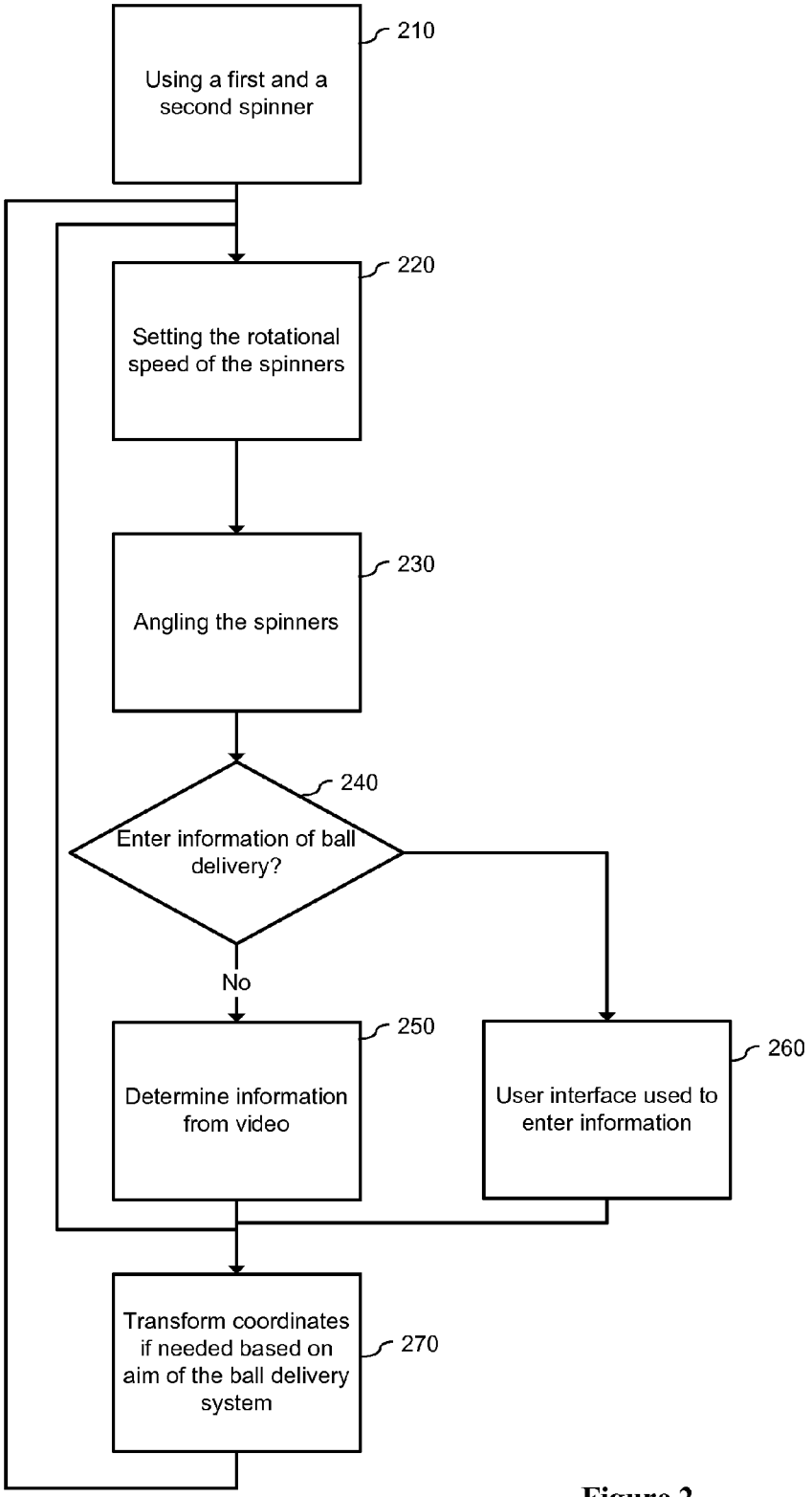
FIG. 2 shows a flowchart, in accordance with various aspects of the present invention.

FIG. 2 shows a flowchart, in accordance with various aspects of the present invention. The flowchart of FIG. 2 illustrates a method for delivery of a ball. FIG. 2 shows using a first and a second spinner 210. The first and second spinners are also shown in the functional block diagram of FIG. 1. FIG. 2 also shows setting the rotational speed of the spinners 220. In one embodiment, the rotational speed of the spinners can be set based on entered information related to the ball delivery 250. In another embodiment, the rotational speed of the spinners can be set based on a video of a ball delivery 260. The determination is made by whether a user has entered information about the ball delivery 240. In one embodiment, the entered information may be a saved delivery. Delivery information entered by a user can be saved. Also, delivery information determined from a video can be saved. In another embodiment some deliveries can be presaved or uploaded in the ball delivery system.

FIG. 2 also shows angling the spinners 230. Similarly, in one embodiment, the angle of the spinners can be set based on entered information related to the ball delivery. In another embodiment, the angle of the spinners can be set based on a video of a ball delivery. If needed coordinate transformation can be achieved 270.

FIG. 3 shows a user interface used in conjunction with a ball delivery system, in accordance with various aspects of the present invention. The user interface includes screen 300. Screen 300 is divided into multiple portions, including entry area 310. In one embodiment, entry area 310 can be used to upload a video, enter ball delivery information, save a ball delivery, or modify a delivery. Buttons can be used to command the various functions. For example, an upload video button 320 can be used for the function of uploading a video. Enter information button 330 can be used to enter ball delivery information. A save button 340 can be used to save a ball delivery. A nudge up button 350, nudge down button 360, nudge left button 370, and nudge right button 380 can be used to slightly modify an existing delivery and a nudge down button 360 can be used to slightly modify a saved delivery.

One advantage of the present invention is the flexibility of either entering ball delivery information or uploading a video. Using the example of a baseball pitch as the ball delivery, a batter may wish to create a pitch to practice. Alternatively, a batter may want to upload a video of a pitcher to practice a particular pitch. Either pitch entry system can be used. If a batter or coach is going to enter information about a pitch directly, the information can be entered as the velocity of the ball, the axis of rotation of the ball, and the rotational velocity or RPMs of the ball. To an inexperienced user of the ball delivery system, it may require several entries of trial and error to obtain a desired pitch for practicing. Any or all of the ball deliveries can be saved in the ball delivery system. Any delivery can also be slightly modified using the nudge up button 350, nudge down button 360, nudge left button 370, and nudge right button 380.

It will be understood to those of skill in the art that the user interface can be implemented on any device that has a user interface, for example, a personal computer, a laptop or portable computer, a smart phone, a tablet, a game console, a specialized user interface designed to communicate with the ball delivery system, a camera, a video camera, etc. In one embodiment, the user interface is implemented using a touch screen. Alternatively, the user interface can be implemented without a touch screen.

It will also be understood to those of skill in the art that the user interface can be used wirelessly or wired to the ball delivery system. Any wireless connection can be implemented including Bluetooth™, IEEE 802.11, or 802.15.4 standards.

Again, using the baseball example, if a batter would like to practice hitting pitches similar to those thrown by a particular pitcher, the batter or coach can upload a video of the pitcher throwing a pitch. In one embodiment, the ball delivery system uses the video to determine the parameters of the ball delivery, i.e., the velocity of the ball, the axis of rotation of the ball, and the rotational velocity or RPMs of the ball.

In another embodiment, the ball delivery system can use a video to determine the parameters of ball delivery with input from a user. For example, a user can pause and slow down a video and use an input device such as a keyboard, mouse or touchscreen to select individual points in time. A user can also select various points on the ball to aid in the determination of the delivery parameters. In one embodiment, a user can also input other data, for example, the position of the camera relative to the baseball field, i.e., the rubber and home plate.

Another advantage of the present invention is the ability of the ball delivery system to provide feedback regarding a batter or tennis player's swing. This swing feedback information can be gathered by sensors or accelerometers worn by the batter or tennis player or embedded in the bat or racquet. Alternatively, a wearable computer can be worn by the batter or tennis player to either control or send batting/hitting feedback to the ball delivery system or both. In one embodiment, a video recording device can be implemented on the ball delivery system to record the batter or tennis player. From that video, information about the batter, for example, stance, weight transfer, hip rotation, shoulder rotation, head movement, and the relative timing of all of these can be determined.

Figure 4:
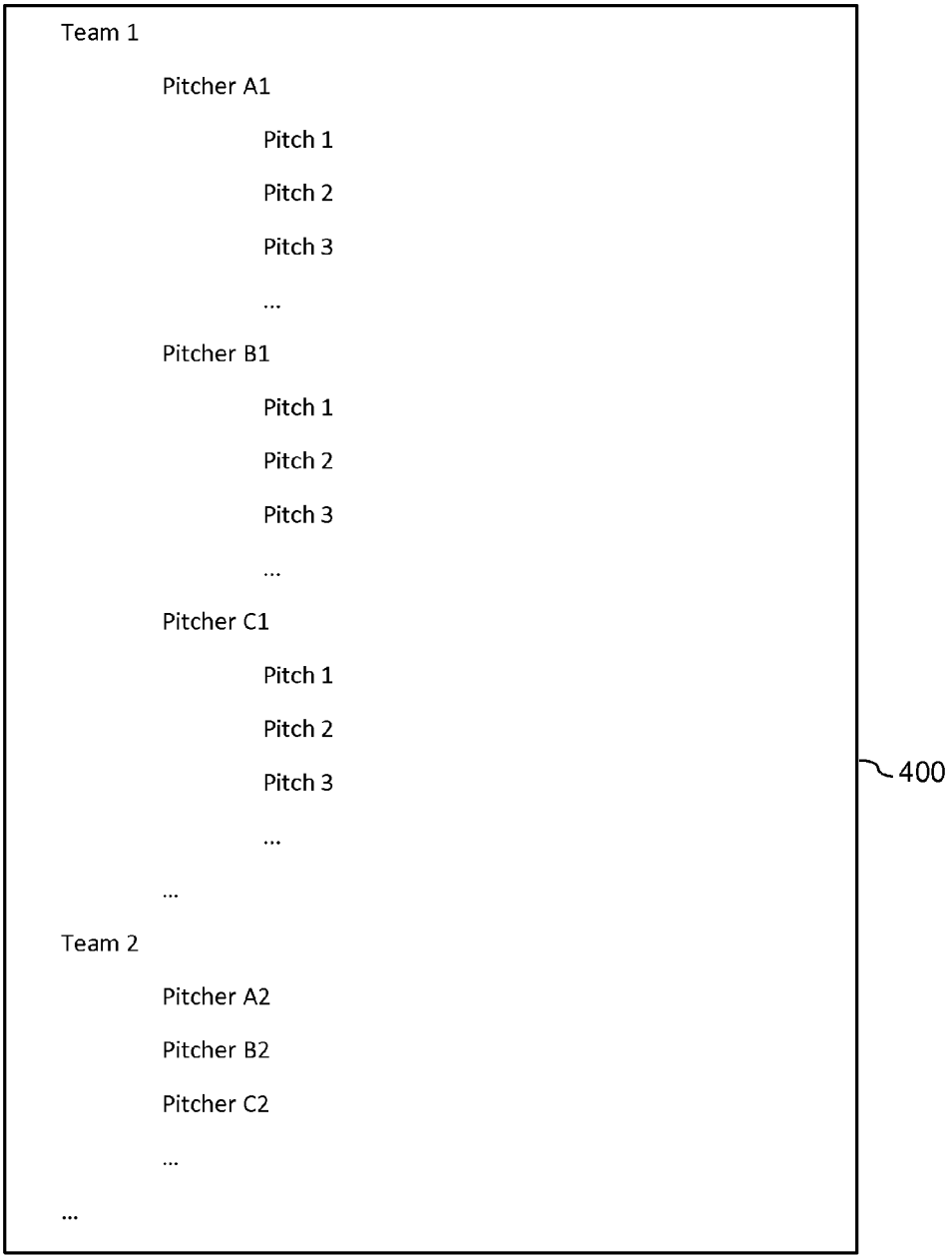
FIG. 4 shows a user interface used in conjunction with user saved deliveries in a ball delivery system, in accordance with various aspects of the present invention.

FIG. 4 shows a user interface illustrating saved deliveries, in accordance with one embodiment of the present invention. Screen 400 shows a hierarchical approach to saving ball deliveries. One example of the hierarchical approach includes organizing the deliveries by team, pitcher, and pitch. Any other organizational approach can also be used in accordance with the present invention. The hierarchical approach can also be displayed using a folder and thumbnail or list hierarchy.

A user interface similar to that shown in FIG. 4 can also be used to save data about a batter, for example. There can be a menu of multiple batters and their hits of various types of pitches. That batter information can also be stored and viewed in a hierarchical format similar to the pitcher information shown in FIG. 4. Viewing this data will better enable a coach, parent or player to design an individualized program for improvement.

Figure 5:
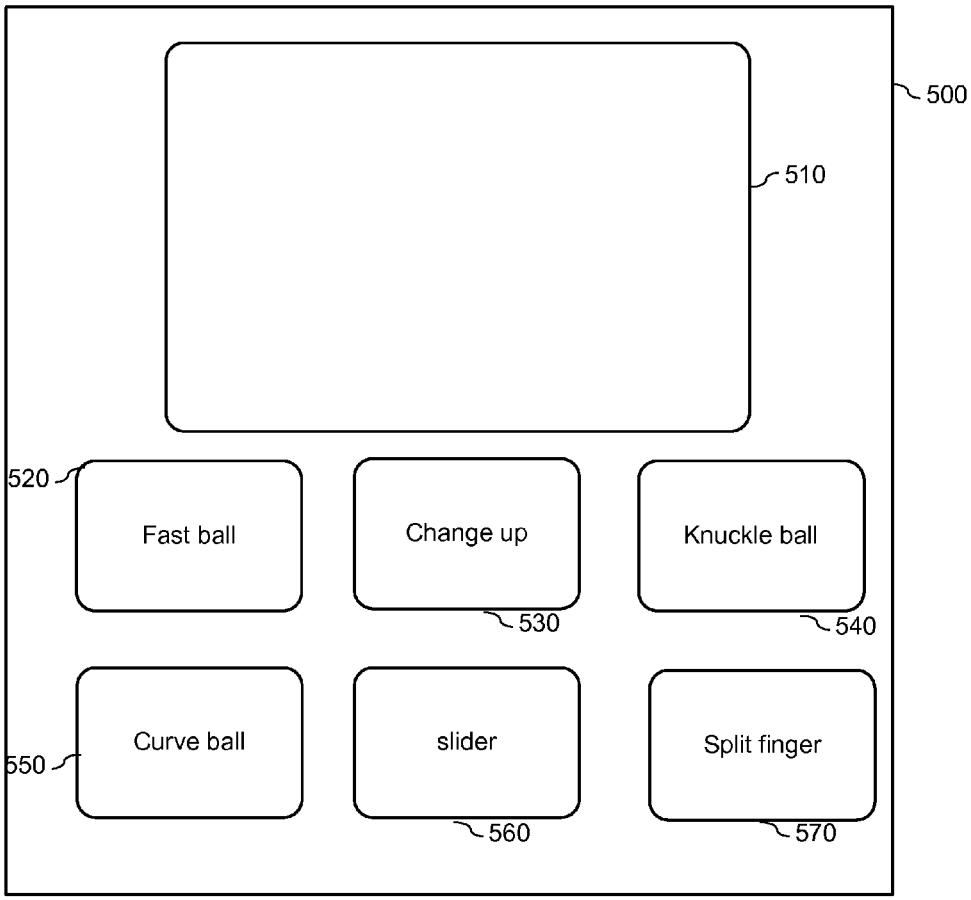
FIG. 5 shows a user interface used in conjunction with pre-saved deliveries in a ball delivery system, in accordance with various aspects of the present invention.

FIG. 5 shows a user interface used in conjunction with pre-saved or uploaded deliveries in a ball delivery system, in accordance with various aspects of the present invention. In one embodiment pre-saved or uploaded deliveries can be stored that would not need to be entered or uploaded by video individually by a user. For example, the ball delivery system can have either a generic or specific pitch or pitches stored in a menu in screen 500. In one embodiment, the ball delivery can use buttons for various types of deliveries or pitches, for example, a fast ball 520, a change up 530, a knuckle ball 540, a curve ball 550, a slider 560, split finger 570, etc. In one embodiment, a user can select a particular button 520-570 and screen area 510 can present a menu of options, for example, beginner, intermediate or advanced pitches. Alternatively, the menu can present choices of the particular pitch by a particular pitcher. The particular pitcher can be in Little League™, high school, college, or Major League or Minor League baseball. In another embodiment deliveries related to tennis, football or any other sport can be stored.

Figure 6:
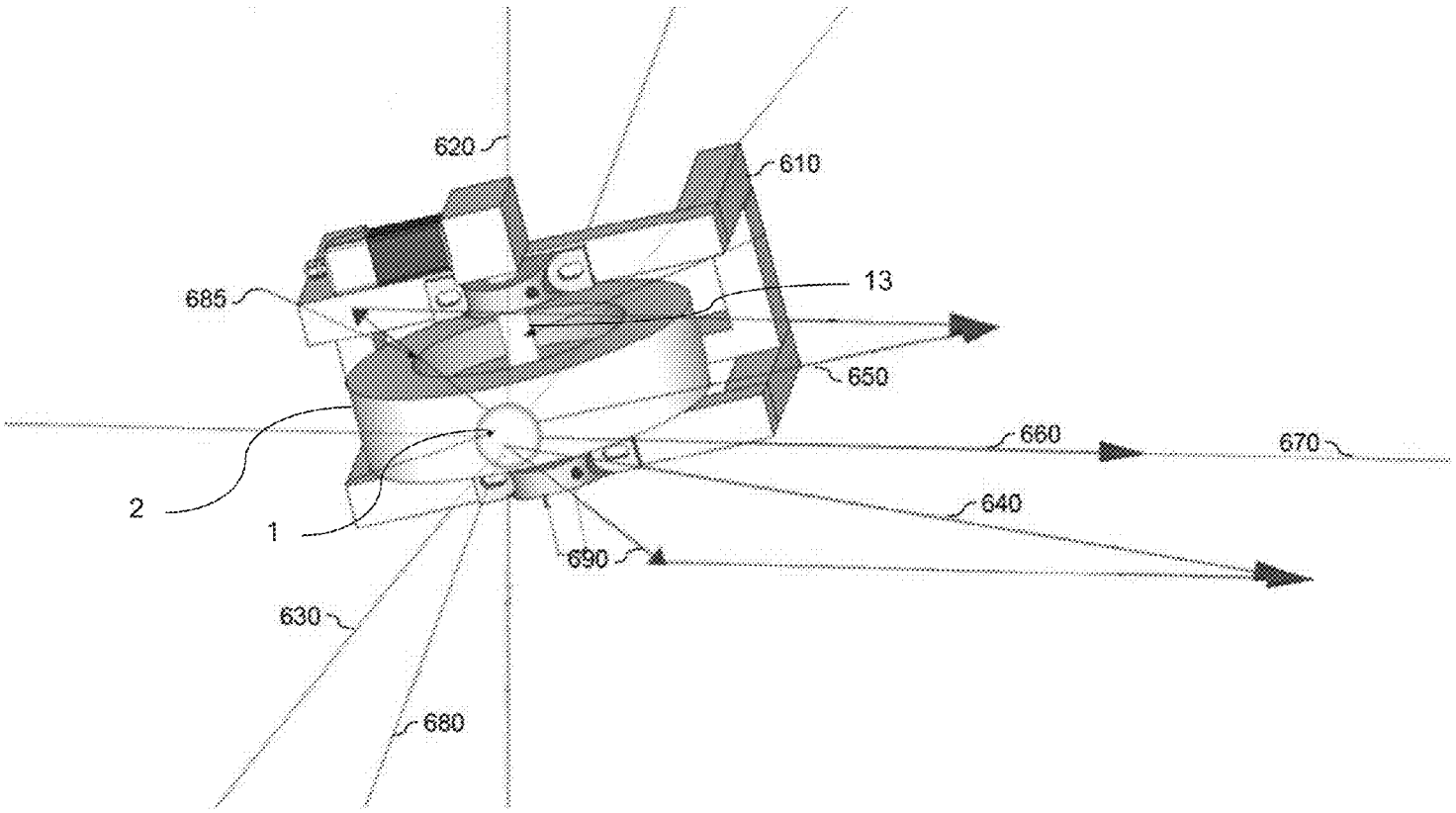
FIG. 6 shows an upper left side perspective view of a single spinner as employed in the ball deliver system, in accordance with various aspects of the present invention.

FIG. 6 shows an upper left side perspective view of a single spinner as employed in the ball deliver system, in accordance with various aspects of the present invention. FIG. 6 shows a single spinner 2, a ball 1, spinner axis 13, and spinner carriage 610. FIG. 6 illustrates the velocity vectors and rotation of the ball when spinner 2 is controlled independently of a second spinner (not shown). The y-axis or p-axis 680 passes through the center of the ball 1 and through the centers of both spinner 2 and the other spinner. Spinner 2 is able to rotate about the p-axis 680. The ball velocity, Vb, the RPM, and the ball axis of rotation can be selected by the user as described above with reference to FIGS. 1-5. In one embodiment, the ball axis of rotation 630, as shown in FIG. 6, lies in the x-z plane and is perpendicular to vectors V1*b* 685 and V2*b* 690, the tangential velocities of ball 1 with respect to its center at two points of contact with spinner 2 and the other spinner, respectively. Vectors V1*b* 685 and V2*b* 690 are equal and opposite. The magnitudes of vectors V1*b* 685 and V2*b* 690 are directly related to the RPMs of ball 1 by the following relationship:

$$|V1b|=|V2b|=|\mathrm{RPM}\pi D|$$ where $D$ is the diameter of the ball.

Vectors V1 650 and V2 640 are the tangential velocities of spinner 2 and the other spinner, respectively, at their points of contact with the ball 1. The magnitudes and directions of V1 650 and V2 640 can be obtained by adding Vb 660 to both V1*b* 685 and V2*b* 690.

$$V1=V1b+Vb \text{ and}$$

$$V2=V2b+Vb$$

The magnitudes of vectors V1 650 and V2 640 determine the rotational speed of the spinners and the directions of V1 650 and V2 640 determine the angles of the spinner 2 axis 13 with respect to the a-axis 670, which is coincident with x-axis in the embodiment shown in FIG. 6.

Figure 7:
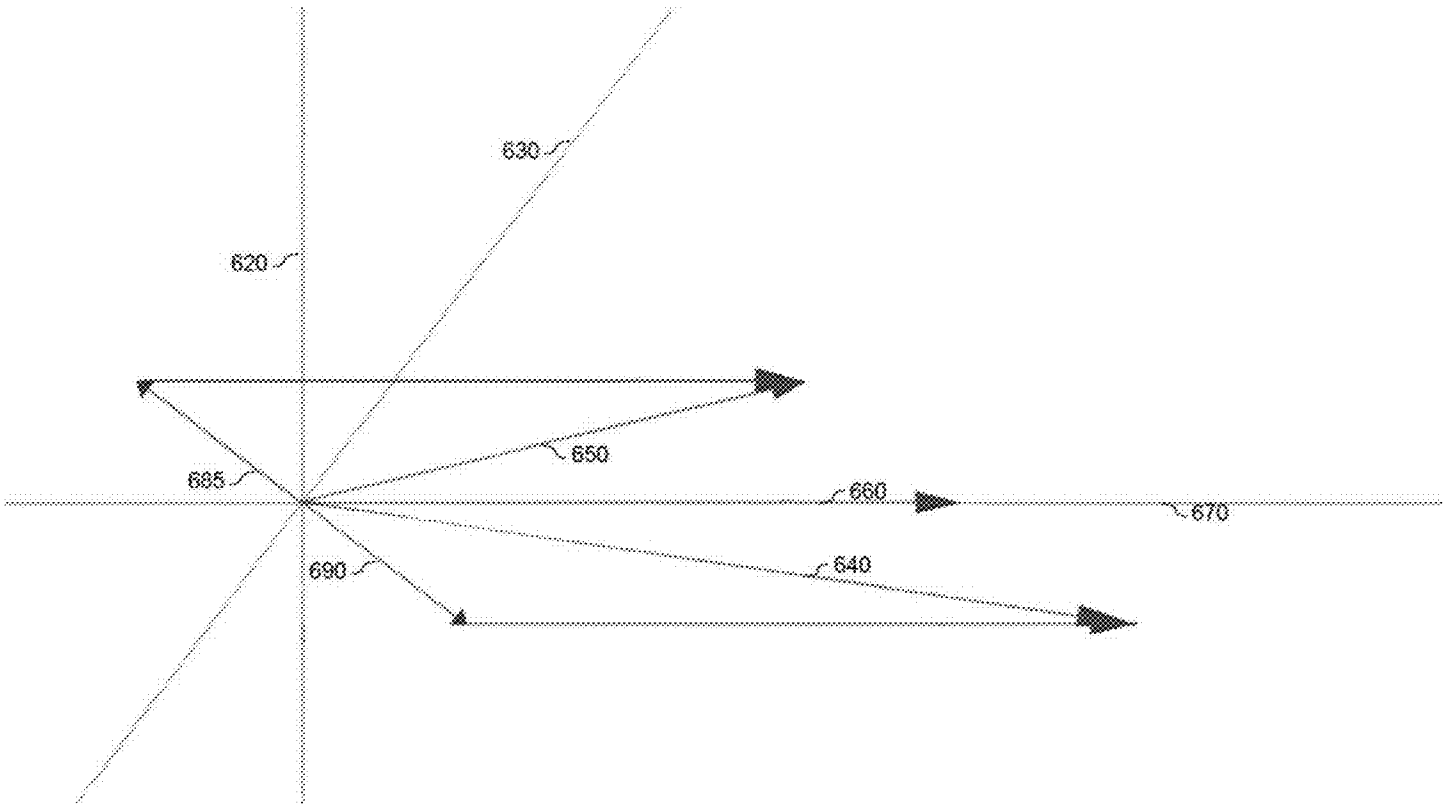
FIG. 7 shows a schematic projection of velocity vectors on the x-z plane, illustrating the vectors from the addition of the ball velocity and tangential velocity vectors, in accordance with various aspects of the present invention.

FIG. 7 shows a schematic representation of velocity vectors on the x-z plane, illustrating the vectors from the addition of the ball velocity and tangential velocity vectors, in accordance with various aspects of the present invention. FIG. 7, shows how the vector addition of the ball's velocity, Vb 660, and its tangential velocities, V1*b* 685 and V2*b* 690 result in vectors V1 650 and V2 640. The vectors in FIG. 7 are also overlaid onto FIG. 6.

Figure 8:
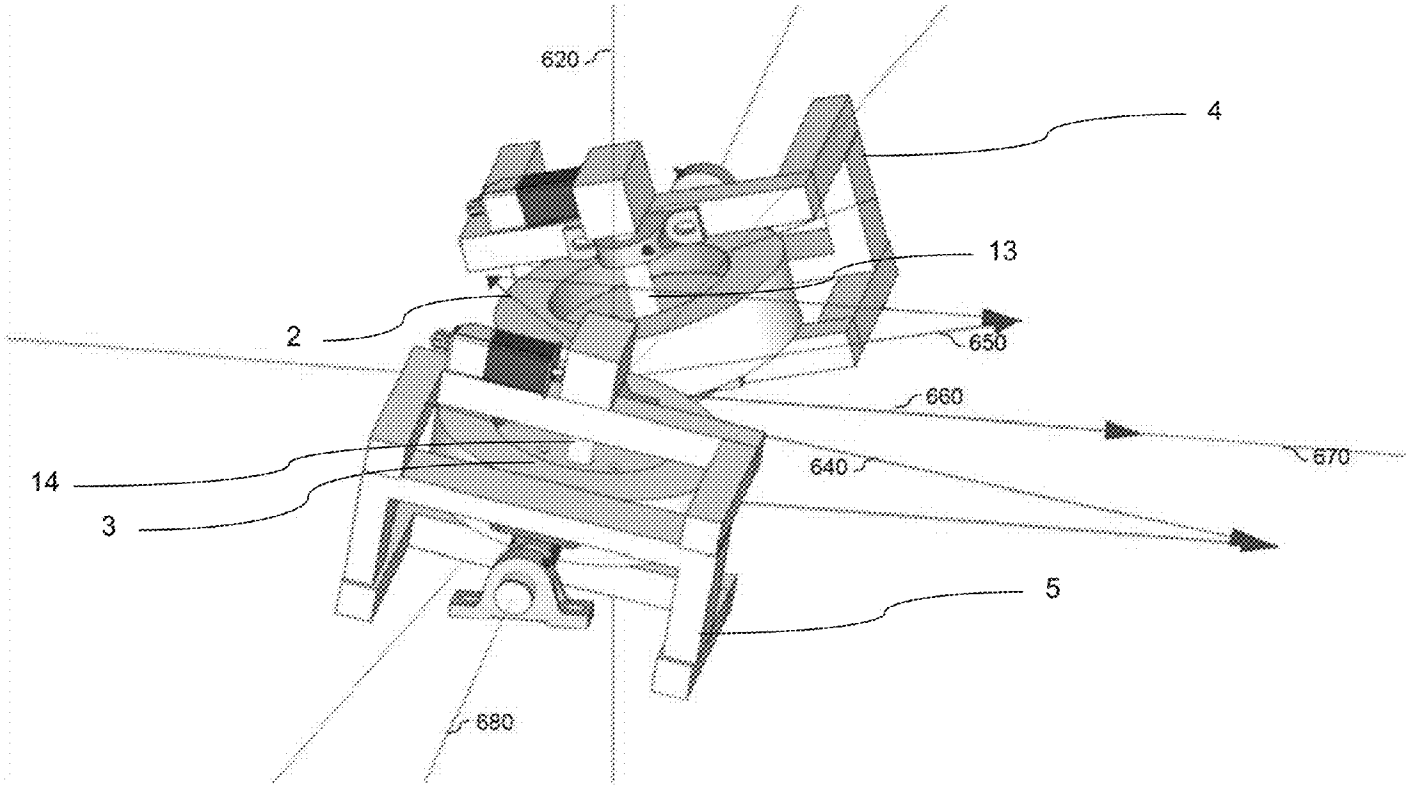
FIG. 8 shows an upper left side perspective view showing the spinners and the spinner support assemblies and further showing how the spinners are oriented so as to rotate around the p-axis, in accordance with various aspects of the present invention.

FIG. 8 shows an upper left side perspective view showing the spinner and the spinner support assemblies and further showing how the spinners 2 and 3 are oriented so as to rotate around the p-axis 680, in accordance with various aspects of the present invention.

FIG. 8 shows the spinners 2 and 3 supported by their respective spinner support assemblies 4 and 5. FIG. 8 illustrates the rotation of the spinners 2 and 3 and their assemblies 4 and 5 around the p-axis 680, which is coincident with the y-axis 680 in this Figure. FIG. 8 also shows the vectors V1 650, V2 640, and Vb 660 as described with reference to FIGS. 6 and 7.

Figure 10:
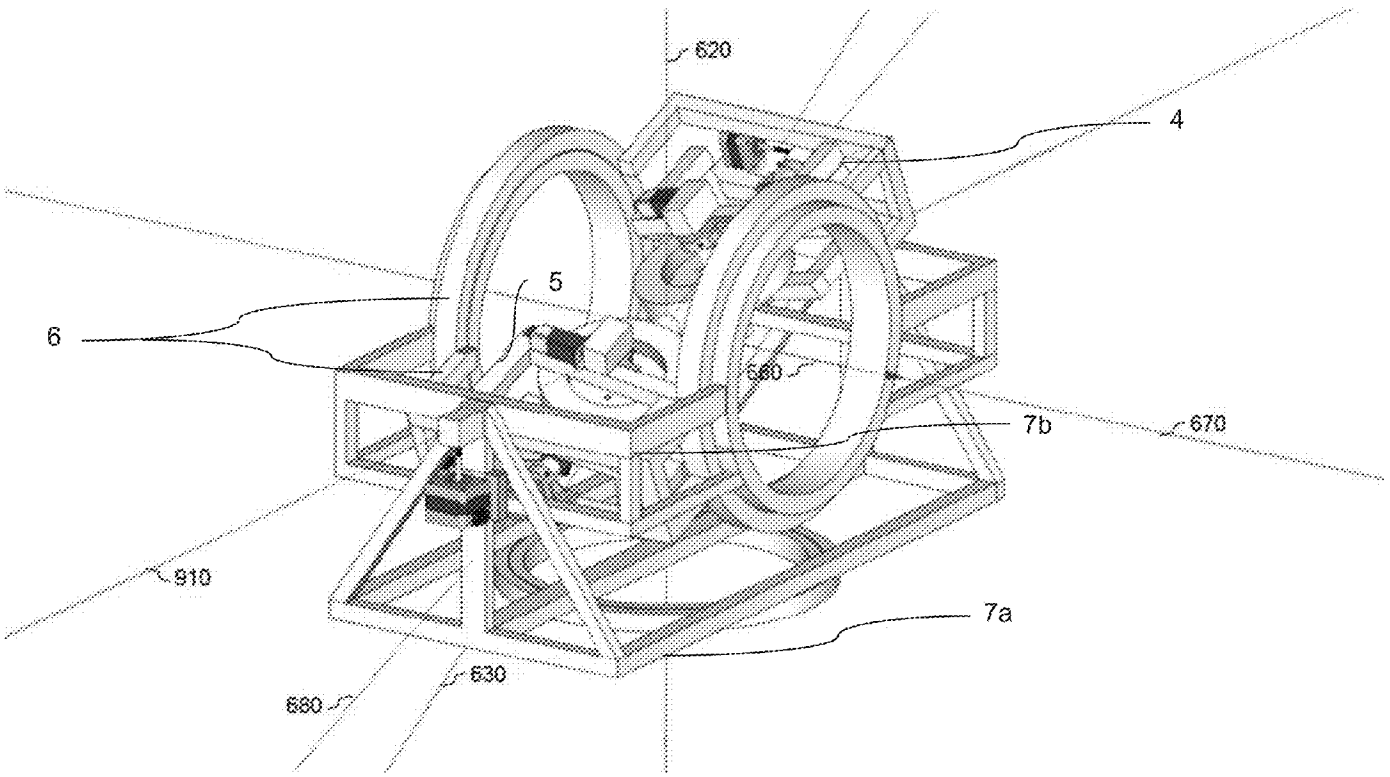
FIG. 10 shows an upper left front perspective view showing how the spinner carriage is mounted on a spinner carriage support basket, in accordance with various aspects of the present invention.

In one embodiment, in order to enable movement of the ball's axis of rotation out of the a-c plane (x-z plane) and rotate it around the a-axis 670 (x-axis), which passes through the center of the ball 1, the spinner support assemblies 4 and 5 are attached to the spinner carriage 6 which is able to rotate freely around the a-axis 670 (x-axis) as it is shown in FIG. 10 in a rotated position.

Figure 9:
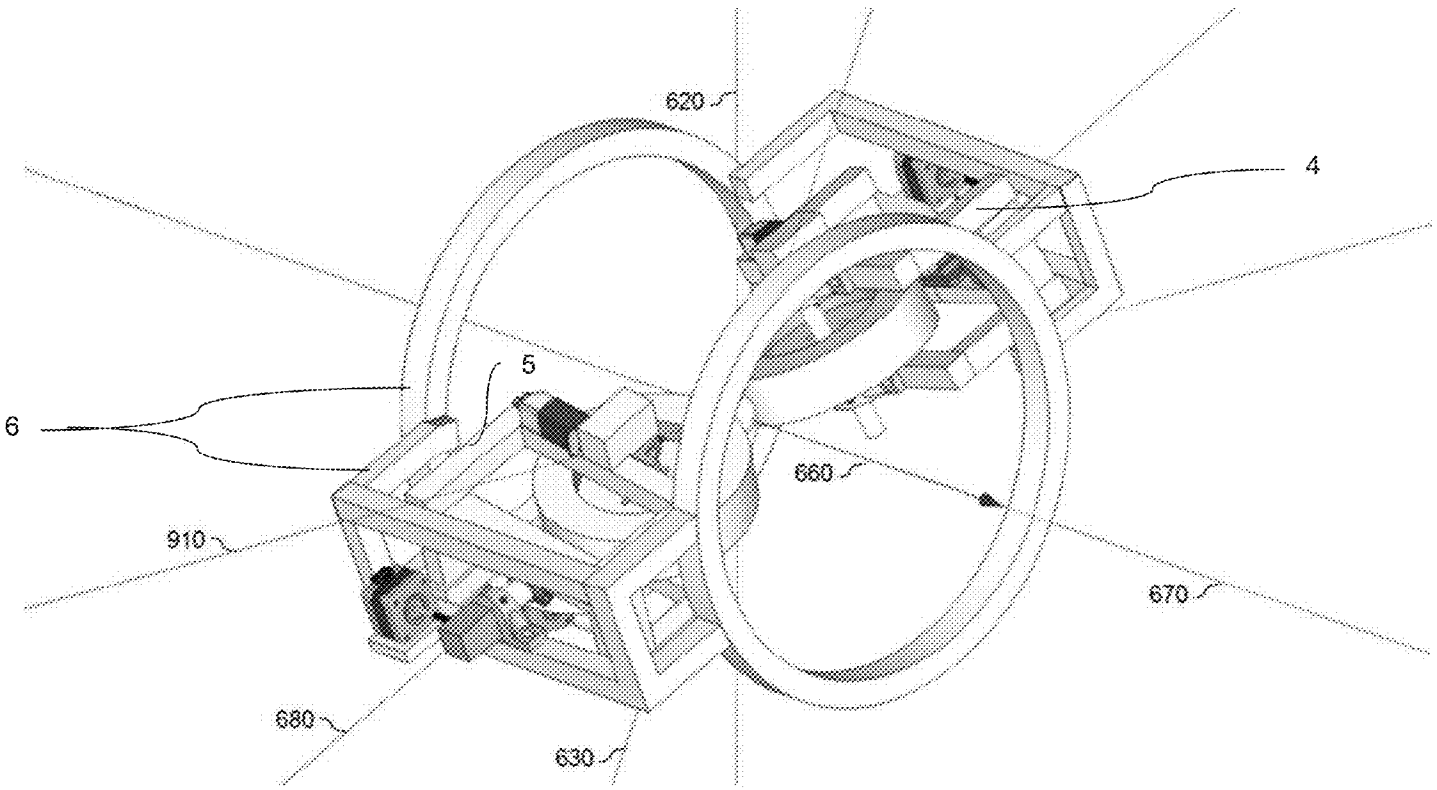
FIG. 9 shows an upper front left perspective view showing how the spinner support assemblies are framed and supported by the spinner carriage, in accordance with various aspects of the present invention.

FIG. 9 shows an upper front left perspective view showing how the spinner support assemblies are framed and supported by the spinner carriage, in accordance with various aspects of the present invention. The configuration shown in FIG. 9, i.e., the combination of 1) the ability to independently rotate the spinners 2 and 3 around the p-axis 680, 2) the ability to independently vary the spinners' 2 and 3 rotational speed, 3) the ability to rotate the spinner carriage 6 around the x-axis 670 (a-axis), 4) the ability to rotate the spinner carriage support basket 7*b* around the y-axis 910 (b-axis), and 5) the ability to rotate the spinner carriage support base 7*a* around the z-axis 620 enables this ball delivery system to produce all possible orientations of the ball's axis of rotation with variable translational velocity in such a manner that the ball is able to reach the target.

FIG. 10 shows an upper left front perspective view showing how the spinner carriage is mounted on a spinner carriage support basket, in accordance with various aspects of the present invention.

Figure 11:
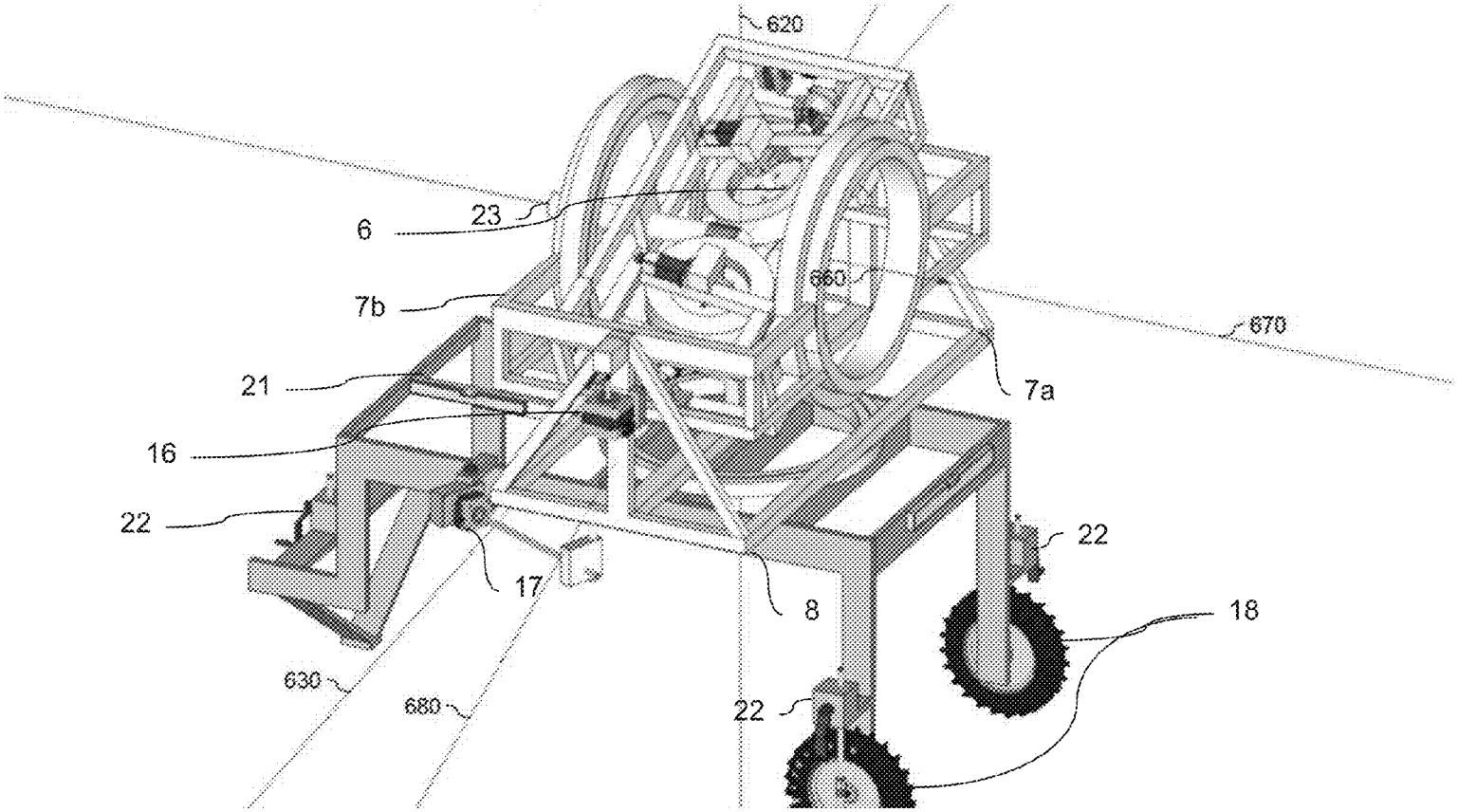
FIG. 11 shows an upper front left perspective view showing how the assembly of FIG. 10 is mounted on a foundation, in accordance with various aspects of the present invention.

FIG. 10 shows the spinner carriage 6 supported by the spinner carriage support assembly basket 7*b*. The spinner carriage support base 7*a* and the spinner carriage support basket 7*b* allow the spinner carriage 6 to rotate around the y-axis 910 (b-axis) for aiming the ball trajectory up or down. The spinner carriage support base 7*a* rests on the foundation 8 and allows rotation of itself around the z-axis 620 as is shown in FIG. 11. Rotation around the z-axis 620 allows aiming the ball's trajectory left or right and rotates the b-axis 910 away from the y-axis 910.

In one embodiment, control of the spinners' rotational speeds is performed by variable speed DC motors mounted on the spinner support assemblies 4 and 5 and linked to the spinners' axes 13 and 14. Control of the rotation of the two spinner support assemblies 4 and 5 around the p-axis 680 is performed by stepper motors 11 and 12 mounted on the spinner carriage 6 and linked to the spinner support assemblies 4 and 5.

Rotation of the spinner carriage 6 around the a-axis 670 (x-axis) is performed by the stepper motor 15 mounted to the spinner carriage support assembly 7 and linked to the spinner carriage 6 as shown in FIG. 13.

After the translational velocity and spin parameters are input into the system, the user must "aim" the system similarly to how a gun turret is aimed vertically and horizontally such that the ball reaches its target. Once the target has been reached by a trial and error process, the user can store all parameters which define a single delivery.

FIG. 11 shows an upper front left perspective view showing how the assembly of FIG. 10 is mounted on a foundation, in accordance with various aspects of the present invention.

FIG. 11 shows the vertical movement can be controlled by a stepper motor 16 mounted on the spinner carriage support base 7*a* that is able to rotate the spinner carriage support basket 7*b* and therefore the entire spinner carriage 6 around the y-axis 910 (b-axis) and thus rotates the a-axis 670 up or down away from the x-axis 670 and rotates the c-axis 620 towards or away from the target and away from the z-axis 620. FIG. 11 also shows the ball introducer tube 23. Introducer tube 23 can be directly connected to the spinner carriage and there for moves in unison. FIG. 11 also shows stepper motor 17. Stepper motor 17 can control the horizontal movement. Stepper motor 17 can be mounted on the foundation 8 that is able to rotate the spinner carriage support base 7*a* around the z-axis and thus rotating the b-axis 910 away from the y-axis 910.

FIG. 11 also shows foundation 8. While delivering a ball foundation 8 of the ball delivery system should be level and pointed in the direction of the target. FIG. 11 shows a cart like apparatus for foundation 8. However, foundation 8 can be any foundation that supports and levels the ball delivery system. The embodiment of foundation 8 shown in FIG. 11 uses two wheels and a third contact point to support the ball delivery system. In the embodiment shown the system is mobile with two wheels 18. The wheels 18 contact the ground or flooring prior to the leveling process. In one embodiment, leving the ball delivery system uses a sight 19, similar to a gun sight, located on the foundation 8 to point the system at the target. Then, the user can use two levels 20 and 21 located on the foundation 8 of the system. Level 20 to determine lateral levelness and the level 21 to determine longitudinal levelness. A manual outrigger system 22 can be in place to lift both wheels 18 to level the foundation 8.

In another embodiment, the user can place the system so that it is in near alignment pointing at the target. Then the user accurately positions the included reflector directly in front of the target clearly visible to the system and the system aligns itself to the reflector automatically. The automatic alignment can be accomplished using three stepper motors controlling the outriggers on the foundation and with feedback from multiple accelerometers located on the primary foundation. The stepper motors can turn lead screws that will lower the outriggers and level the primary foundation. A fourth stepper motor located on the primary foundation turns a lead screw connected to the secondary foundation and rotates it laterally and with feedback from an infrared camera located on the secondary foundation, the secondary foundation will be pointed at the target. The secondary foundation can have a light emitting diode infrared red light and camera mounted on the front facing the target.

After the foundation 8 has been positioned, the ball delivery system 100 allows adjustment of all aspects of the delivery to be made without changing position of the ball 1 in three dimensional space at which it is accelerated by contact with the spinners 2 and 3. This is possible because all adjustments are made by rotation around the a-axis 670, p-axis 680, or z-axis 620 which all share the same origin at the center of the ball 1 when it is in contact with the spinners 2 and 3.

Figure 12:
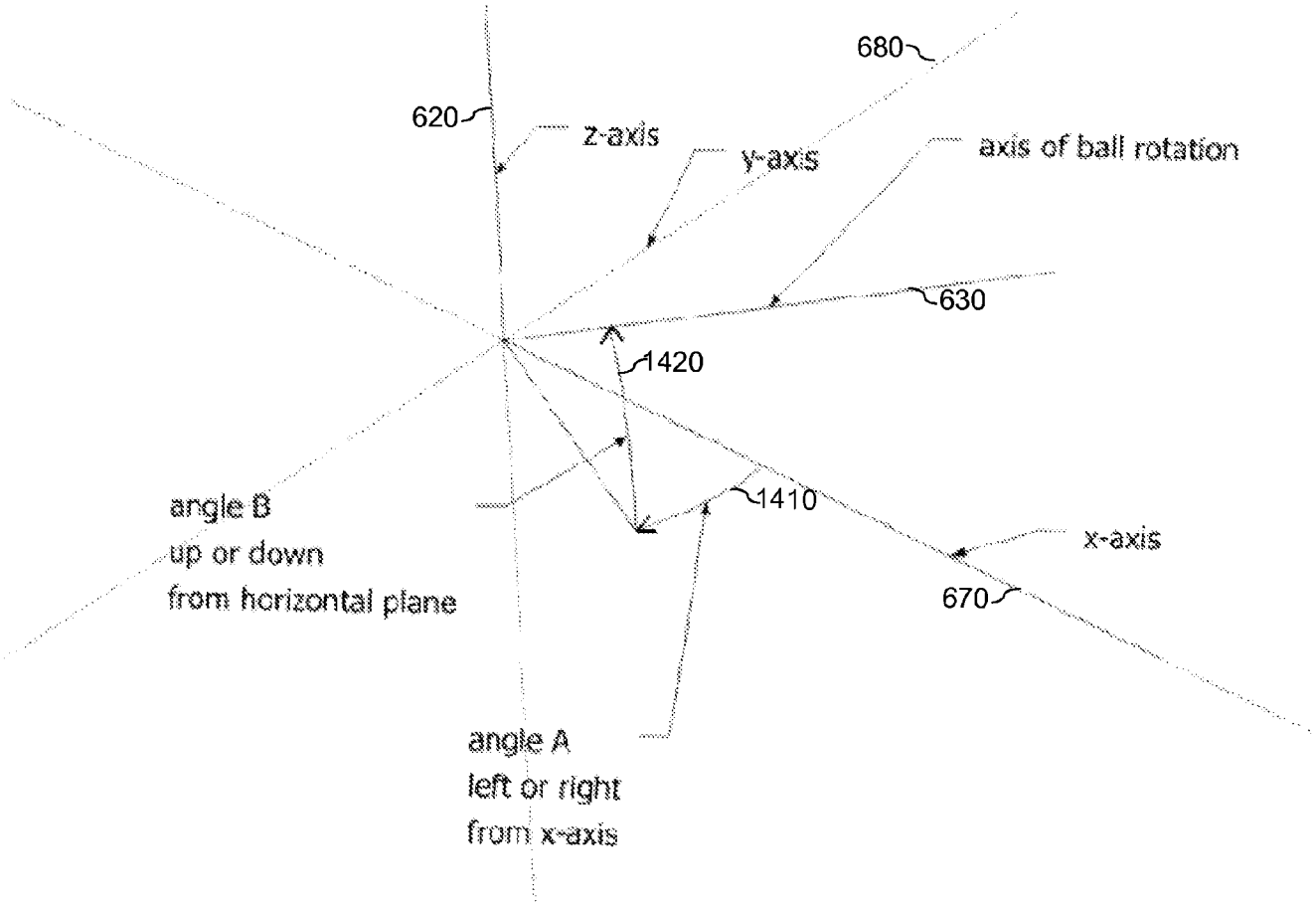
FIG. 12 shows a schematic view showing the mechanical geometry, in accordance with various aspects of the present invention.

FIG. 12 shows a schematic view showing the mechanical geometry, in accordance with various aspects of the present invention.

The "spin" of the ball is defined as encompassing the orientation of the axis of rotation, direction of rotation, and rotational speed which are all input by the user. The orientation of the axis of rotation is broken down into two angles, A, and B, as shown in FIG. 12.

One way a user can input a delivery is using parameters: angle A, angle B, translational velocity and RPM. As can be easily imagined, the spin and velocity of the ball will effect its movement after exiting the ball delivery system. In order for the system to obtain the horizontal and vertical angles of declination necessary to reach the target for a particular delivery, the user can aim the system by a trial and error process. Since aiming the system requires rotating the spinner carriage support assembly basket 7*a* (shown in FIG. 11) around the b-axis and/or rotation of the spinner carriage support base 7*b* around the z-axis, the aiming process effectively alters the orientation of the ball's axis of rotation away from what was originally determined by angles A and B in FIG. 12. Therefore, the ball delivery system can perform a coordinate system transformation each time either one or both of the above rotations are performed due to aiming in order to maintain the true orientation of the axis of rotation with respect to level ground and the target. Once the user determines by trial and error the correct horizontal and vertical angles of declination, the delivery has been defined and the user is able to store and name that particular delivery.

It will be apparent to one of ordinary skill in the art that aspects of the present invention can be implemented as a software application running on a mobile device such as a mobile phone or a tablet computer. It will be apparent to one of ordinary skill in the art that the present invention can be implemented as firmware in an field programmable gate array (FPGA) or as all or part of an application specific integrated circuit (ASIC) such that software is not required. It will also be apparent to one of ordinary skill in the art that computer readable media includes not only physical media such as compact disc read only memory (CD-ROMs), SIM cards or memory sticks but also electronically distributed media such as downloads or streams via the internet, wireless or wired local area networks or interfaces such as Ethernet, HDMI, USB, Bluetooth or Zigbee, etc., or mobile phone system.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications, combinations, permutations, and variations as may fall within the spirit and scope of the appended claims.

I claim:

1. A ball delivery method, a ball delivered by the ball delivery method having an axis of rotation, a rotational velocity and a delivery described by a velocity and a trajectory, the method comprising:

using a first and a second spinner capable of delivering the ball, the first and the second spinner forming two points of contact with the ball, the first spinner having a first rotational axis and the second spinner having a second rotational axis;

using exactly two simultaneous contact points with the ball;

setting the rotational speed of the first spinner and the second spinner independently;

angling the first spinner to have the first rotational axis;

angling the second spinner to have the second rotational axis, independently of the first spinner, where the first rotational axis and the second rotational axis are angled independently; and rotating a spinner carriage assembly enclosing the first spinner and the second spinner, where rotating the spinner carriage assembly rotates a plane containing the axis of rotation of the ball and rotates the spinner carriage about an axis parallel to an axis defined by the trajectory.

2. The ball delivery method of claim 1, further comprising entering the velocity of the ball.

3. The ball delivery method of claim 1, further comprising entering the axis of rotation of the ball.

4. The ball delivery method of claim 1, further comprising entering a desired target of the ball.

5. The ball delivery method of claim 1, further comprising entering the rotational velocity of the ball.

6. The ball delivery method of claim 1, further comprising storing information related to the ball delivery.

7. The ball delivery method of claim 1, further comprising transforming coordinates to maintain control over the delivery of the ball.

8. The ball delivery method of claim 1, further comprising using a front facing camera coupled to a processor with computer vision software that would enable monitoring of the delivered ball.

9. The ball delivery method of claim 1, further comprising connecting to an internet to obtain ball delivery information.

10. The ball delivery method of claim 1, further comprising delivering the ball to achieve a desired pitch described by the axis of rotation of the ball, the rotational velocity of the ball, the velocity of the ball, and trajectory of the ball.

11. A ball delivery system, a ball delivered by the ball delivery system having an axis of rotation, a rotational velocity and a delivery described by a velocity and a trajectory, the system comprising:

a spinner delivery system, including a first and a second spinner, each spinner having an angle of orientation and a speed of rotation, the first and the second spinner having exactly two simultaneous contact points with the ball;

a first stepper motor coupled to the first spinner, the first motor capable of adjusting the angle of the first spinner;

a second stepper motor coupled to the second spinner, the second motor capable of adjusting the angle, independent of the angle of the first spinner of the second spinner;

a first adjustable speed direct current motor capable of adjusting the rotational speed of the first spinner;

a second adjustable speed direct current motor capable of adjusting the rotational speed of the second spinner, independent of the rotational speed of the first spinner;

a spinner carriage assembly enclosing the first spinner and the second spinner, where rotating the spinner carriage assembly rotates a plane containing the axis of rotation of the ball and rotates the spinner carriage about an axis parallel to an axis defined by the trajectory;

a stepper motor coupled to the spinner carriage assembly, the stepper motor capable of rotating the spinner carriage assembly; and a foundation assembly coupled to the spinner carriage, the foundation assembly capable of moving independently of the spinner carriage.

12. The system of claim 11, a microcontroller coupled to the first and second motors.

13. The system of claim 11, further comprising a user interface.

14. The system of claim 13, wherein the user interface is capable of having information about the ball delivery entered, the information about a ball delivery described by the axis of rotation of the ball, the rotational velocity of the ball, the velocity of the ball, and trajectory of the ball.

15. The ball delivery system of claim 14, wherein the information about the ball delivery described by the axis of rotation of the ball, the rotational velocity of the ball, the velocity of the ball, and trajectory of the ball is used to configure the ball delivery system wherein the ball delivery will have properties contained in the information about the ball delivery.

16. The ball delivery system of claim 11, further comprising a front facing camera coupled to a processor with computer vision software that would enable monitoring of the delivered ball.

17. The ball delivery system of claim 11, further comprising an internet coupled to the ball delivery system enabling the ball delivery system to obtain ball delivery information from the internet.

18. A spinner ball delivery system, a ball delivered by the ball delivery system having an axis of rotation, a rotational velocity and a delivery described by a velocity and a trajectory, the system comprising:

a first spinner;

a first actuator module configured to control a first angle of orientation of the first spinner;

a first speed control module configured to control a rotational speed of the first spinner;

a second spinner, the first and second spinners forming exactly two simultaneous contact points with the ball;

a second actuator control module configured to control a second angle of orientation of the second spinner independent of the first spinner, independent from the first angle of orientation;

a second speed control module configured to control a rotational speed of the second spinner;

a spinner carriage assembly enclosing the first spinner and the second spinner, where rotating the spinner carriage assembly rotates a plane containing the axis of rotation of the ball and rotates the spinner carriage about an axis parallel to an axis defined by the trajectory;

a stepper motor coupled to the spinner carriage assembly capable of rotating the spinner carriage assembly; and a foundation assembly coupled to the spinner carriage, the foundation assembly capable of moving independently of the spinner carriage.

19. The system of claim 18, wherein the first and second actuator modules and speed control modules are capable of controlling the spinners in response to a coordinate transformation as a result of movement of the ball delivery system.

* * * * *